United States Patent [19]

Wender

[11] Patent Number: 4,702,383

[45] Date of Patent: Oct. 27, 1987

[54] TAMPER PROOF PACKAGE

[75] Inventor: Harry Wender, Forest Hills, N.Y.

[73] Assignee: Filtromatic Corp., Glendale, N.Y.

[21] Appl. No.: 894,119

[22] Filed: Aug. 7, 1986

[51] Int. Cl.[4] ..... B65D 41/34

[52] U.S. Cl. ..... 215/232; 215/230; 215/252

[58] Field of Search ..... 215/230, 232, 252

[56] References Cited

U.S. PATENT DOCUMENTS

| | | | |
|---|---|---|---|
| 2,390,291 | 12/1945 | Blackman | 215/252 |
| 4,197,955 | 4/1980 | Luenser | 215/232 X |
| 4,493,427 | 1/1985 | Wolkonsky | 215/252 X |

*Primary Examiner*—Donald F. Norton

*Attorney, Agent, or Firm*—Howard F. Mandelbaum

[57] ABSTRACT

A tamper-proof package includes a vessel, closure and locking member having downwardly and outwardly extending tabs of a contrasting color welded to the vessel. The tabs are frangible to break upon twisting of the cap to provide visibly contrasting evidence of tampering observable from above the package.

4 Claims, 4 Drawing Figures

FIG. 1
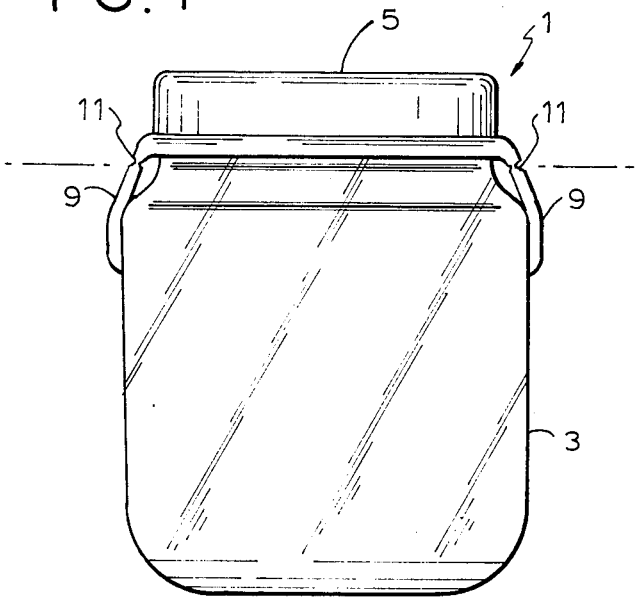
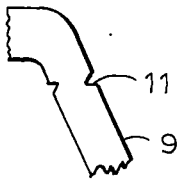
FIG. 4
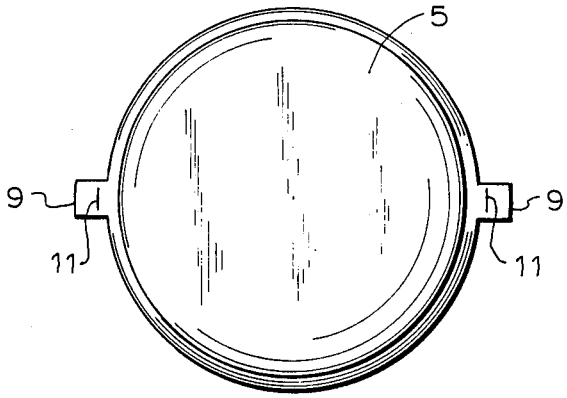
FIG. 3
FIG. 2
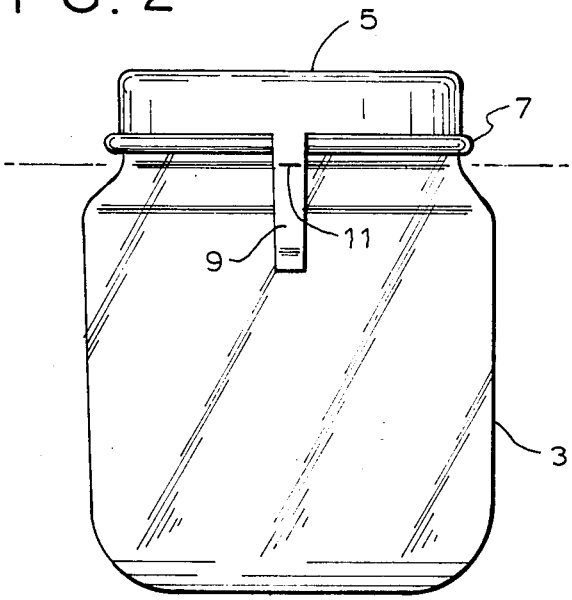

TAMPER PROOF PACKAGE

BACKGROUND OF THE INVENTION

The problem of tampering with sealed packages containing ingestible substances such as food and drugs to deliberately adulterate their contents is well known. Recent instances of the introduction of poisonous chemicals and harmful matter such as fragmented glass into such packages have received great notoriety.

There are numerous packages on the market which employ a frangible cap mounted on the neck of a jar or bottle, e.g., soda bottles and pill and capsule bottles, by crimping or the like. Even supposedly tamper-proof packages have been penetrated unbeknownst to their consumers resulting in injury and death. By carefully resealing packages after tampering, criminals have been able to cover up their tampering leading consumers to believe that an adulterated package is factory fresh and unopened.

Part of the difficulty in detecting tampering with prior art protection devices lies in the necessity to view the closure of a package at eye level to detect the tampering. Most frequently, packages are viewed from above as a consumer comfortably holds the package in a hand below eye level.

SUMMARY OF THE INVENTION

The present invention seeks to overcome the problems associated with prior art so-called tamper-proof packages by teaching the construction of a package and closure combination which when opened and resealed leaves a highly visible indication that the package has been violated. More specifically, the invention teaches the construction of a tamper indicating package including a container having a circular opening, a cap removably mounted over the container opening, and connecting means having an upper member affixed to the cap and at least one downwardly extending tab means affixed to the container, the connecting means being of a color different from the colors of the cap and container and having a frangible section adapted to break upon rotation of the cap relative to the container, whereby the contrast between the colors of the broken frangible section and container provides a readily visible indication of tampering.

It is therefore an object of the invention to provide a tamper proof package which provides and indication of tampering even after the package is carefully resealed.

Another object of the invention is to provide a tamper proof package wherein tampering is evidenced by a contrast in colors between different portions of the package.

A further object of the invention is to provide a tamper proof package wherein evidence of tampering is visible from above the package.

Other and further objects of the invention will be apparent from the following drawings and description of a preferred embodiment of the invention in which like reference numerals are used to indicate like parts in the various views.

DESCRIPTION OF THE DRAWINGS

FIG. 1 is a frontal elevation view of a tamper proof package in accordance with a preferred embodiment of the invention.

FIG. 2 is a side elevation view of a tamper proof package in accordance with a preferred embodiment of the invention.

FIG. 3 is a plan view of a tamper proof package in accordance with a preferred embodiment of the invention.

FIG. 4 is an enlarged view of a portion of the tamper proof package of FIG. 1.

DESCRIPTION OF THE PREFERRED EMBODIMENT

Referring now to the drawings, there is shown a package 1 including a vessel 3 in the form of a bottle or jar, a closure 5 and a locking ring 7.

The closure 5 is in the form of a cap having threads (not shown) on its interior circumference for mating with complementary threads (not shown) on the exterior circumference of the neck of the vessel 3. In the preferred embodiment of the invention, the vessel 3 is made of a transparent glass or plastic material and the closure 5 is formed from an opaque plastic material or a metal.

The locking ring 7 has diametrically opposed downwardly and outwardly extending tabs 9. The locking ring is fixedly connected to the closure 5. After threading the closure 5 onto the neck of the vessel 3, the lowermost ends of the tabs 9 are welded to the outer surface of the vessel 3 so that the closure 5, vessel 3 and locking ring 7 are fixedly connected.

The locking ring 7 is preferably formed from a reasonably brittle plastic and has a color different from and contrasting with the colors of the closure 5 and vessel 3.

The tabs 9 are provided with cutouts 11 approximately midway down their respective lengths to form frangible sections which break upon twisting of the closure 5 relative to the vessel 3 to open the package 1.

Fracturing of the tabs 9 at the cutouts 11 provides visible evidence that the package 1 has been opened. The contrasting colors of the locking ring 7, vessel 3 and closure 5 make the fractures highly visible and difficult to conceal, even if an attempt is made to refasten the fractured portions of the tabs 9 after the package 1 has been opened.

The downward and outward direction of the tabs 9 makes the area of the frangible cutouts 11 highly visible from above the package 1 so that evidence of tampering can be readily seen without raising the package to eye level.

It is to be appreciated that the foregoing is a description of a preferred embodiment of the invention to which variations and modifications can be made without departing from the spirit or scope of the invention.

What is claimed is:

1. A tamper indicating package comprising a container having a circular opening, a cap removably mounted over said container opening, and connecting means having an upper member affixed to said cap and at least one downwardly and outwardly extending tab means affixed to said container, said tab means having a frangible section intermediate the ends of said tab means adapted to break upon rotation of said cap relative to said container to provide a readily visible indication of tampering.

2. A tamper indicating package in accordance with claim 1, wherein said connecting means comprises two diametrically opposite tab means.

3. A tamper indicating package in accordance with claim 1, wherein said tab means is welded to said container.

4. A tamper indicating package in accordance with claim 1, wherein said container is transparent and said connecting means is opaque.

* * * * *